US005351765A

United States Patent [19]

Ormsby

[11] Patent Number: 5,351,765

[45] Date of Patent: Oct. 4, 1994

[54] CORING ASSEMBLY AND METHOD

[75] Inventor: Ronald D. Ormsby, Houston, Tex.

[73] Assignee: Baroid Technology, Inc., Houston, Tex.

[21] Appl. No.: 114,534

[22] Filed: Aug. 31, 1993

[51] Int. Cl.[5] ..... E21B 25/00

[52] U.S. Cl. ..... 175/58; 175/246; 175/325.3

[58] Field of Search ..... 175/58, 77, 78, 246, 175/325.3

[56] References Cited

U.S. PATENT DOCUMENTS

| | | | |
|---|---|---|---|
| 2,256,092 | 9/1940 | Koebel et al. . | |
| 2,540,464 | 2/1951 | Stokes . | |
| 2,543,861 | 3/1951 | Mader . | |
| 2,634,956 | 4/1953 | Stokes . | |
| 2,708,103 | 5/1955 | Williams, Jr. . | |
| 2,708,105 | 5/1955 | Williams, Jr. . | |
| 2,769,615 | 11/1956 | Burgess . | |
| 3,741,323 | 6/1973 | Constantinescu et al. | 175/246 |
| 3,777,826 | 12/1973 | Wolda | 175/246 X |
| 3,986,555 | 10/1976 | Robertson | 175/246 |
| 4,512,416 | 4/1985 | Rowley et al. | 175/58 |
| 4,518,050 | 5/1985 | Sollie et al. | 175/58 X |
| 4,518,051 | 5/1985 | Sollie et al. | 175/58 x |
| 4,573,539 | 3/1986 | Carroll et al. | 175/58 |
| 4,735,269 | 4/1988 | Park et al. | 175/58 X |

OTHER PUBLICATIONS

Composite Catalog of Oil Field Equipment & Services, 1980–1981, vol. I published by World Oil, p. 125.

Composite Catalog of Oil Field Equipment & Services, 1980–1981, vol. I published by World Oil, p. 1812.

*Primary Examiner*—Ramon S. Britts

*Assistant Examiner*—Frank S. Tsay

*Attorney, Agent, or Firm*—Browning, Bushman, Anderson & Brookhart

[57] ABSTRACT

Coring apparatus and method are disclosed which provide for hydraulic latching of an inner core barrel within an outer core barrel. The apparatus includes a valve face disposed around the inner core barrel and valve seat disposed around the bore of the outer core barrel that close to form a restriction in the drilling fluid flow path. A hydraulic differential force is thereby created which holds the inner barrel in place. Axially oriented bores in a hanger assembly and in stabilizers are disposed along the inner core barrel to provide a flow path for the drilling fluid after the restriction is formed. The bores are calibrated to produce a predetermined hydraulic force on the inner barrel. A bearing assembly is used to prevent transmission of outer barrel rotation to the inner core barrel. The outer surface of the bearing assembly forms the valve face so as to form the drilling fluid restriction and also provides an axial stop that prevents further axial movement of the inner barrel towards the core head.

22 Claims, 5 Drawing Sheets

16
28
10
12
25
18
22
20
14
24
26
32
30
34
27
40
36
38
42
44

FIG. 9
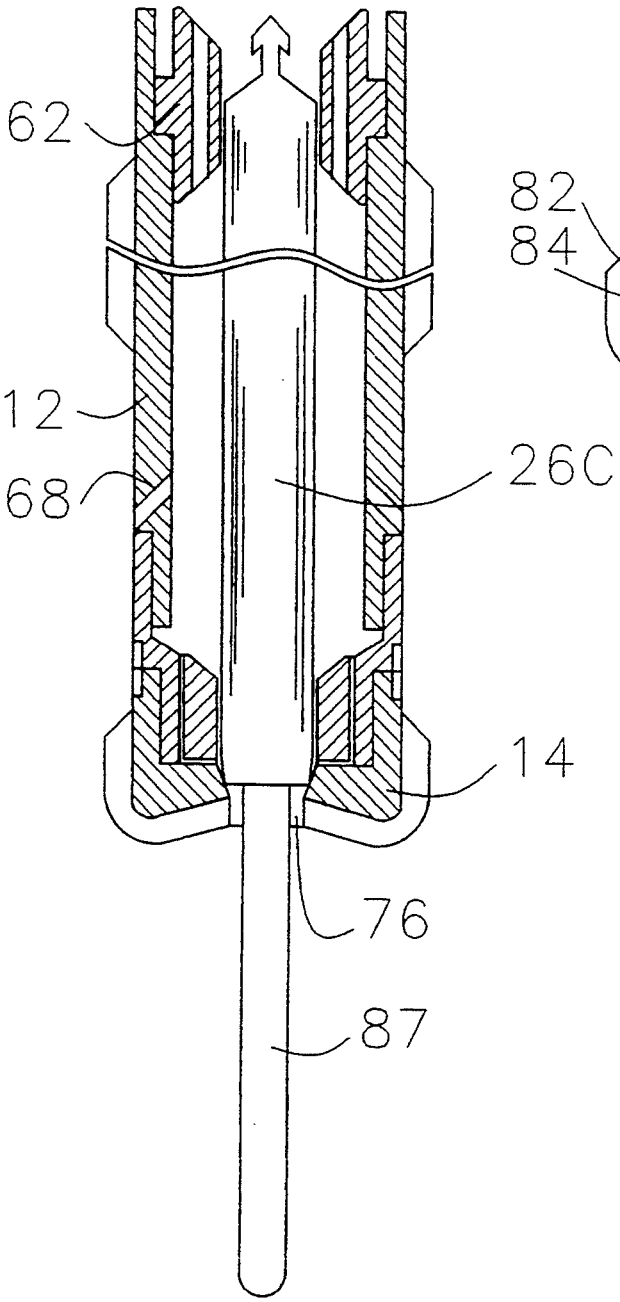
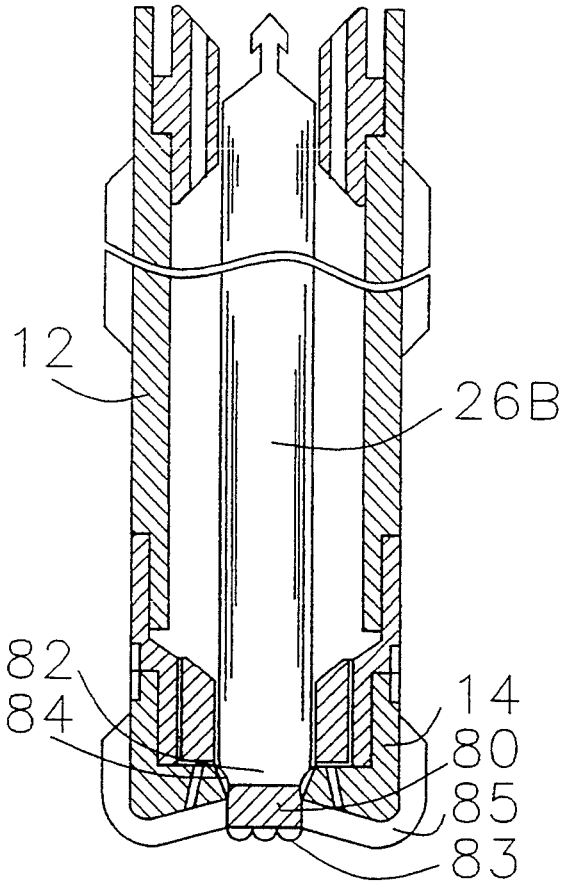
FIG. 8

CORING ASSEMBLY AND METHOD

BACKGROUND OF THE INVENTION

1. Field of the Invention

The present invention relates generally to coring assemblies and, more particularly, to apparatus and methods for facilitating inner core barrel latching in coring assemblies.

2. Description of the Background

Conventional coring tools for obtaining core samples from a borehole comprise a tubular housing attached at one end to a special bit often referred to as a core head, and at the other end to a drill string extending through the borehole to the surface. The tubular housing includes an inner and outer barrel with a space between. During normal drilling the drilling fluid may flow through the interior of the inner barrel. When a core sample is required, the flow passageway is blocked, often by dropping a ball from the earth's surface, thus diverting the flow into the space between the inner and outer barrel and down through the bit. The absence of flow in the inner barrel allows the earth formation to enter and fill the barrel, which is then subsequently recovered as a core.

Wire-line retrievable coring tools are often used to allow multiple core samples to be taken without the need to remove the drill string. Retrieval of continuous samples allows for enhanced core analysis, including mechanical rock properties, mineralogy and lithology (including petrography), rock fabric (including grain size), stratigraphic correlation, and paleontology. Preferably all zones of interest are captured to enhance the entire hydrocarbon recovery process from geologic interpretation through reservoir management. As well, enhanced analysis of the above-reservoir formations allows the operator to better address problems such as well-bore stability and fluid/formation capability.

Wire-line retrievable coring tools typically have latching mechanisms which hold the inner barrel in place at a fixed axial orientation with respect to the outer barrel. While the inner barrel must be held in a fixed position axially, it must also be free to rotate with respect to the outer barrel to avoid twisting the core. The latch mechanism must reliably latch the inner barrel in place when the inner barrel is lowered into position and it must reliably unlatch the inner barrel to allow retrieval of the core sample via wireline.

Latching problems may prevent the coring tool from obtaining a core sample thus costing rig time and loss of information. For instance, the latching mechanism may fail to latch the inner barrel in position prior to taking a core sample so that the core never enters the inner core barrel. Such a failure may not be readily discernable from the surface. Thus, the failure to latch may result in a failure to obtain a desired core sample from a potentially producing zone of interest in the formation. After drilling through the zone, the core sample may be more difficult to obtain and may be more contaminated with drilling fluid than if the sample was obtained in the first place without failure of the latch.

While the most common latching failure is that of the inner barrel failing to latch to the outer barrel, it is also possible to have an unlatching failure where the coring tool fails to unlatch after the surface operator believes the inner core sample has been taken. Such a failure results in the need to pull the drill string with the attendant cost in time. As well, latching mechanisms require additional cost for manufacturing as well as ongoing cost of maintenance.

Consequently, there remains a need for a coring assembly that offers dependable operation at reduced levels of capital investment. Those skilled in the art have long sought and will appreciate the present invention which provides solutions to these and other problems.

SUMMARY OF THE INVENTION

The coring assembly of the present invention may be used with a core head rotatable by a drill string and disposed within a wellbore. The core head has a core head bore therethrough for receiving the core sample and the drill string has a bore therethrough for pumping drilling fluid. The coring assembly of the present invention comprises an outer core barrel having a bore therethrough for receiving an inner core barrel. The outer core barrel is connected with the core head for rotation therewith. The inner barrel is axially movable within the outer barrel bore along the axis of the outer barrel bore and has a first end and a second end with the second end being disposed closer to the core head than the first end. A support member is affixed to the outer barrel along the bore of the outer barrel. The support member has an annular valve seat means centrally disposed therein with a bore therethrough for receiving the inner barrel. The support member also has a drilling fluid pathway disposed therein to allow axial flow of drilling fluid around the valve seat means. A valve face means is disposed around the inner barrel. The valve face means and the valve seat means are sealingly engageable to form a drilling fluid flow restriction for producing a pressure differential within the outer core barrel between the first and second ends of the inner core barrel and are operable for holding the inner barrel assembly within the outer core barrel in an axially fixed position with respect to the outer core barrel. The valve face means and valve seat means are substantially rotatably fixed with respect to each other after engagement. The drilling fluid is diverted to the drilling fluid pathway after engagement of the valve face means and the valve seat means.

In operation, the core head and outer coring barrel are connected together and lowered into the well bore on the end of the drill string. After the drill string is in the desired position, the inner core barrel may be dropped into the drill string. A drilling fluid mud pump is connected to the drill string to provide circulation through the drill string. After engagement of the valve seat and valve face, a flow restriction is formed between the first and second ends of the inner core barrel. Pumping drilling fluid through the drill string axially secures the inner core barrel within the outer coring barrel using a differential fluid pressure which arises from the drilling fluid flow through the flow restriction. The differential pressure rotatably secures a portion of the inner core barrel to the outer core barrel so that portion of the inner core barrel rotates with the outer core barrel.

It is an object of the present invention to provide an improved coring assembly and method.

It is another object of the present invention to provide a coring assembly with an inner barrel held firmly in an axial position by means of a pre-determined differential drilling fluid hydraulic pressure created by calibrated restrictions in the drilling fluid flow path.

It is yet another object of the present invention to provide a coring assembly with a latching assembly that operates without downhole moving parts.

A feature of the present invention are valve seat and valve face elements that act simultaneously as a restriction in the drilling fluid flow path and as an axial stop to prevent further axial movement of the inner barrel towards the core head.

Another feature of the present invention is a bearing race that allows rotation of the coring portion of the inner barrel with respect to the outer barrel while also providing a surface to act as a valve face in forming a restriction to drilling fluid flow.

An advantage of the present invention is the elimination of the need for a downhole mechanical latch mechanism with laterally moving parts that may become inoperable.

These and other objects, features, and advantages of the present invention will become apparent from the drawings, the descriptions given herein, and the appended claims.

BRIEF DESCRIPTION OF THE DRAWINGS

FIG. 8 is an elevational view, partially in section, showing a drill plug for the bore through a coring head in accord with the present invention; and FIG. 9 is an elevational view, partially in section, showing a logging tool for logging through the bore in the coring head.

Figures 1, 2, 3, 4:
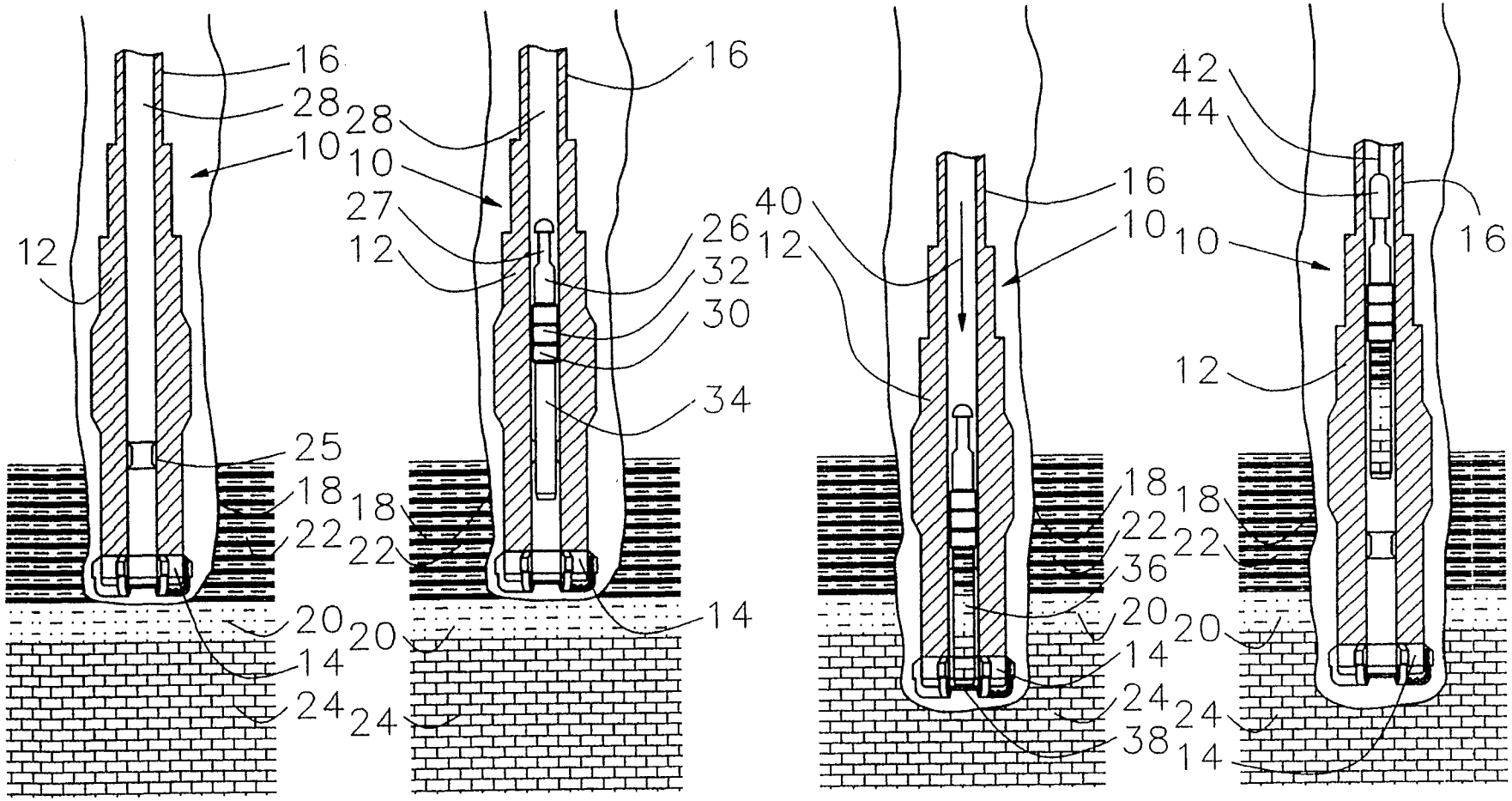
FIG. 1 is an elevational view, partially in section, of an outer barrel assembly in accord with the present invention shown about to drill into a zone of interest.
FIG. 2 is an elevational view, partially in section, showing the inner barrel being dropped into position within the outer barrel.
FIG. 3 is an elevational view, partially in section, showing a core sample being received into the inner barrel while drilling through the zone of interest.
FIG. 4 is an elevational view, partially in section, showing the core sample and inner barrel being retrieved by wireline.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

Referring now to the drawings, and more particularly to FIGS. 1–4, the general operation of coring assembly 10, in accord with the present invention, is illustrated.

FIG. 1 shows outer barrel 12 connected to core head 14 and placed on the end portion of drill string 16. The assembly is positioned on the bottom portion of the well bore 18 prior to entering geological zone of interest 20. Zone of interest 20 is layered between other geological formations 22 and 24. Hanger assembly 25 in bore 28 forms an axial stop for inner barrel 26.

FIG. 2 illustrates how inner barrel 26 is placed within outer barrel 12 of coring assembly 10. While the length of inner barrel 26 may be varied as desired up to about 90 ft, a preferred 32 ft. inner barrel permits recovery of a full 30 ft. joint, and a preferred 15 ft. barrel can be used for radial coring. Outer barrel 12 including hanger assembly 25 is adjusted to correspond to the chosen length of inner barrel 26. The length and diameter of inner barrel 26 is preferably chosen to allow conformance with standard components. For instance the system operates with standard drill string and drilling services so that no customization is required. Inner barrel 26 passes through a standard 2 13/16" bore with standard 4½" XH connectors. As shown, inner barrel 26 drops through bore 28 in the direction of core head. Due to close tolerances between the bore size at the drilling collars and the O.D. of inner barrel 26, inner barrel 26 slows in speed considerably through the drilling collars. Inner barrel 26 is preferably pumped to the bottom using surface mud pumps (not shown). It may also be placed in position by force of gravity although if well bore 18 is at a high angle or substantially horizontal, then pumping is required. Inner barrel 26 includes lower race bearing 30 and upper race bearing 32. Each of these races rotate with respect to each other and with respect to coring portion 34 of inner barrel 26. Using this bearing assembly, the weight of inner barrel is effectively hung on ball bearings. Fishing neck 27 allows inner barrel 26 to be retrieved by wireline as discussed hereinafter.

In FIG. 3, inner barrel 26 is seated on hanger assembly 25 in bore 28. Further axial movement of inner barrel 26 in the direction of core head 14 is prevented by hanger assembly 25. Lower race bearing 30 engages hanger assembly 25. Thus, the remainder of inner barrel 26 is free to rotate with respect to outer barrel 12. While outer barrel 12 rotates, inner barrel 26 remains substantially stationary with respect to the formation so as to avoid twisting off the core sample. Core sample 36 is received through bore 38 of core head 14 as drilling proceeds. Inner barrel 26 is held firmly in its axial position by drilling fluid flow indicated by arrow 40. As discussed hereinafter, a differential hydraulic pressure of the drilling fluid arises due to a restriction formed at hanger 25 and acts to hold inner barrel 26 in position within outer barrel 12 during the coring operation. The drilling fluid hydraulic pressure replaces the latch found in most wireline retrievable coring tools. Without latches and related mechanical devices, the tool is subject to fewer mechanical difficulties during coring. This prevents expensive down time. The inner barrel may be made of different materials for optimized retrieval in a variety of formations. For instance, aluminum with a low coefficient of friction may be used to reduce friction between the inner barrel and core sample. Steel treated for non-stick applications may also be used.

FIG. 4 illustrates the retrieval operation of core sample 36 after drilling through zone of interest 20 using wireline 42. Typically, core head 14 is picked off the bottom and the core sample is broken off with full volume on the pumps. Then, the pumps are turned off. Overshot 44 is adapted to connect with fishing neck 27 in a manner well known to those skilled in the art. After attachment, inner barrel 26 may be pulled to the surface using slick line, sand line, or other wirelines as may be available or desirable. The weight of the inner barrel, which may be up to 90 feet in length, including the corresponding core sample, is generally in the range of 600–700 lbs. Therefore inner core barrel 26 can be pulled from even relatively deep wells with most types of wireline including conventional wireline, slickline, or sandline without danger of parting the line. Conceivably inner barrel 26 and core sample 36 could also be retrieved by reverse circulation and using a suitable catcher assembly (not shown) at the surface. After retrieval, if more coring is desired, the same sequence as described with respect to FIGS. 1–4 may be repeated as often as necessary until coring is finished. Thus, long, continuous sections can be cored in a manner which saves rig time. As well, a core head seal plug or core heat bit plug may be used between runs with inner core barrel 26 or a modified version thereof as discussed hereinafter in connection with FIG. 7 and FIG. 8.

Figure 5:
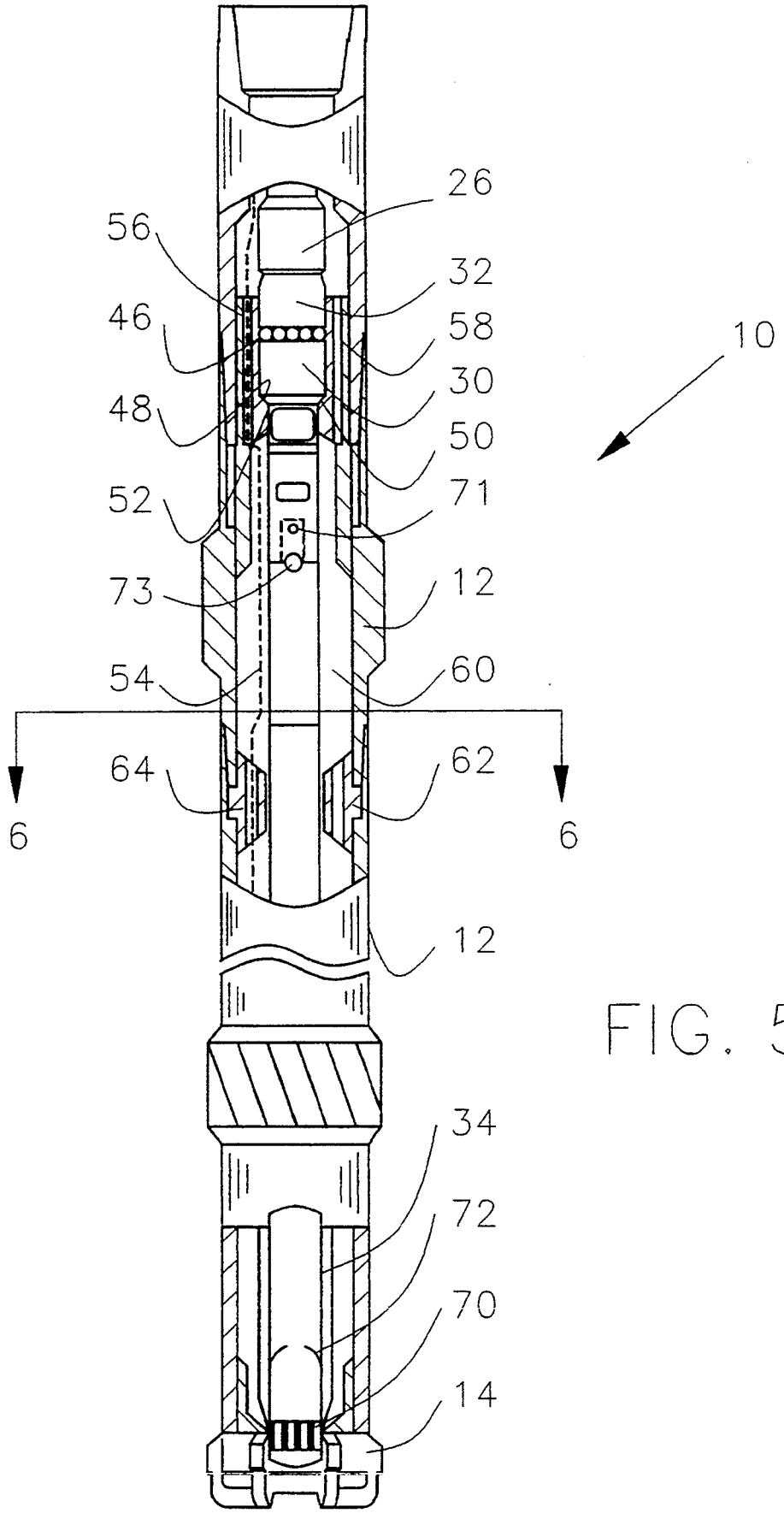
FIG. 5 is an elevational view, partially in section, of a coring system in accord with the present invention.
Figure 5A:
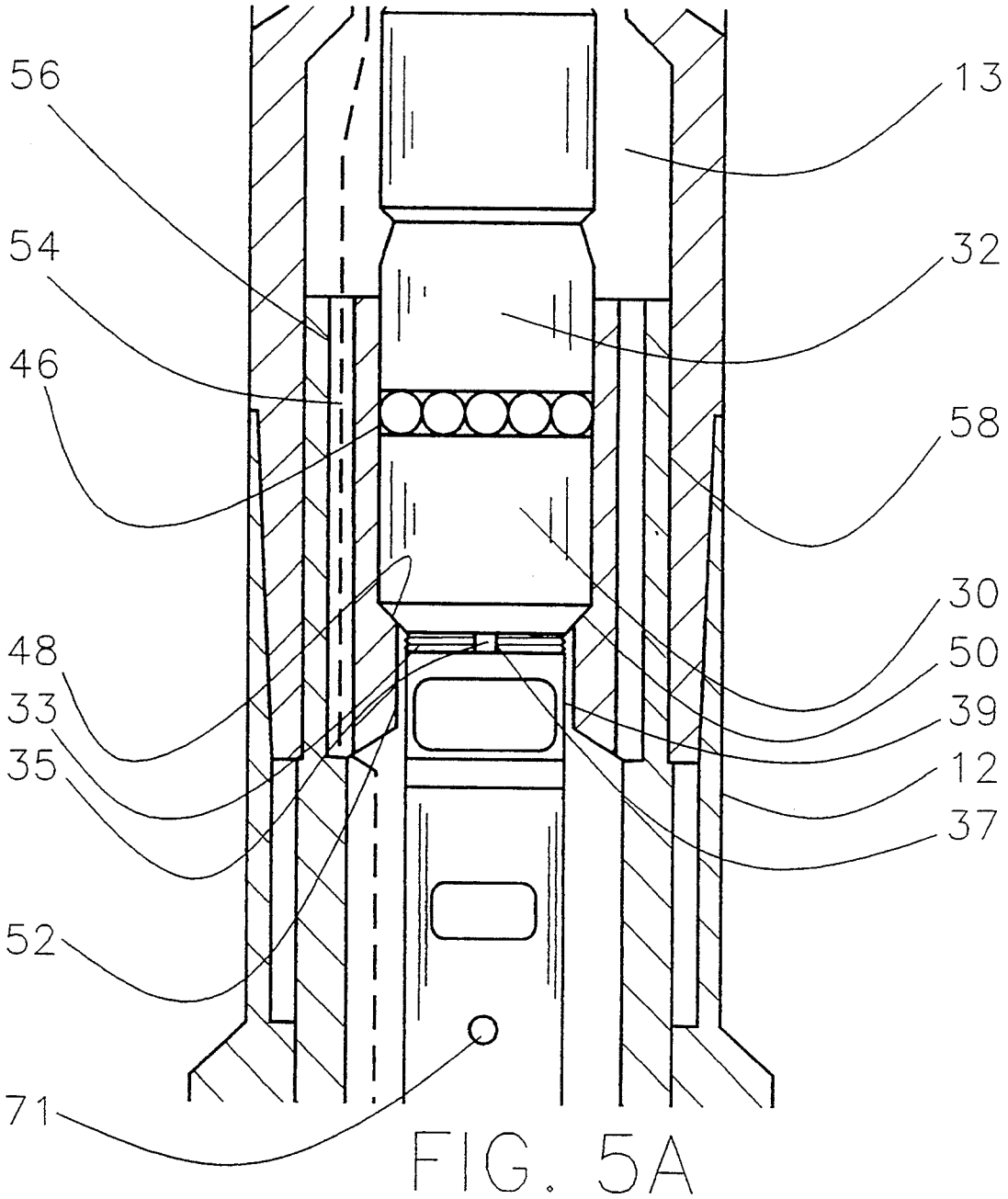
FIG. 5A is an enlarged view, partially in section, of the bearing and seating arrangement shown in FIG. 5.

Referring now to FIG. 5 and FIG. 5A, additional details of coring assembly 10 according to the presently preferred embodiment are disclosed. Lower bearing race 30 and upper bearing race 32 are shown along with ball bearings 46. This bearing assembly allows inner core barrel 26 to remain stationary while outer core barrel 12 rotates with core head 14. Using two bearing races interconnected by ball bearings allows the weight of inner core barrel 26 to be supported by ball bearings 46. Lower bearing race 30 is available for engaging with seat surface 48 to suspend inner core barrel 26 in an axial fixed position within outer core barrel 12 whereby inner core barrel 26 is free to rotate with respect to outer core barrel 12. Thus, the bearing assembly prevents the rotation of the drillstring from being transmitted to the inner core barrel so as to damage or prevent recovery of the core sample. Although other bearing arrangements could be used, preferably the bearing assembly should be of the frictionless type so that the weight of the inner barrel rests on ball bearings.

The bearing assembly is preferably mud-lubricated i.e. a flow of drilling fluid through the bearing assembly provides the necessary lubrication. For this purpose, timed threads 33 are used with key 35 and slot 37 to hold adjusting nut 39 in a position axially spaced from the bearing assembly that allows flow through the bearing assembly as well as retains the bearing assembly in place. While approximately two threads 33 are shown for illustrative purposes, one thread or one-half thread, depending also on how slot 37 is arranged, may provide enough axial space to allow adequate flow through the bearing assembly. A differential pressure as discussed hereinafter will provide sufficient mud flow through the bearings. Using mud-lubricated bearings eliminates the need for sealed bearings which may fail if the seal breaks.

Lower bearing race 30 has a frustoconical portion 48 which mates to frustoconical seat surface 50. This may be seen more clearly in enlargement FIG. 5A. These surfaces effectively form the face and seat of a valve which has a valve bore 52 therethrough and closes to prevent fluid flow through valve bore 52. Because the frustoconical valve face portion 48 and mating valve seat surface 50 are engaged and held in place by hydraulic pressure they are rotatably and axially fixed to each other. Thus valve face portion 48 and valve seat surface 50 rotate with outer core barrel 12 and inner core barrel 26 is prevented from further axial movement along the bore 13 of outer coring barrel 12 towards core head 14.

In the preferred embodiment, lower bearing race 30 actually performs at least three functions. It acts as a surface to form an axial stop to prevent axial movement of inner core barrel towards core head 14. It also acts as the race of the bearing assembly which allows inner core barrel 26 to rotate with respect to outer core barrel 12. Part of its surface acts as a valve to form the flow restriction which gives rise to the hydraulic pressure that holds the inner core barrel in position. It will be recognized that separate parts could be used to perform these functions but that it is more efficient to use one component. For instance, a rotation joint could be placed in the inner core barrel below an axial stop point. As well, the valve action or flow restriction means could be in the form of a choke within outer core barrel 12 and the outer cylindrical diameter of a portion of inner core barrel 26.

Once valve bore 52 is sealed, drilling fluid flow through the bore 13 of outer coring barrel 30 is altered to proceed through flow path 54 as indicated by the dotted line. It is not necessary that the seal formed be absolute but rather that it seal well enough so the restricted flow can be determined reasonably accurately. Other surface shapes besides the preferred frustoconical shape could be used. The restricted flow through flow path 54 creates a hydraulic pressure differential that acts to secure inner barrel 26 in the position shown. Thus, the hydraulic pressure at the top end of inner barrel 26 is higher than the hydraulic pressure at the lower end nearer the core head.

After frustoconical valve face portion 48 engages frustoconical valve seat surface 50, fluid flow must proceed through axial bores such as bore 56 in hanger assembly 58. Axial bore 56 is disposed radially outwardly with respect to valve bore 52. Drilling fluid flow then continues towards core head 14 along annulus 60 until reaching stabilizer 62. Depending on the length of inner barrel 26, up to five stabilizers such as stabilizer 62 are used to prevent bending of inner barrel 26 that may impede the entrance of the core sample. Preferably multiple flow paths are available through stabilizer 62 such as axial bore 64 as discussed in connection with FIG. 6.

Catcher 70 is normally used to hold the core sample in place but basket catcher 72 may be alternatively installed above catcher 70 to improve recovery in unconsolidated formations. Catcher 70 is housed in a core catcher sub to form a core catcher assembly that provides the means for breaking the core from the bottom as well as retaining it within the inner core barrel. The core catcher assembly may be removed to retrieve the core sample from inner barrel 26.

For unconsolidated formations such as coal, it may also be desirable to have a flow path for drilling fluid through outer core barrel 12 (as shown in FIG. 9 with ports 68) rather than a flow path over the core head 14. If the drilling fluid flows over unconsolidated formation, the formation may collapse or broken down and be washed away by the drilling fluid rather than proceeding through core head 14 to catcher 70 and into inner coring barrel 26 for recovery. Thus, placement of port 68 as shown allows for reverse circulation as the fluid flows down the outside of outer barrel 12 and then reverses when it reaches core head 14.

One-way ball valve vent 71 allows ventilation of chamber 75 (See FIG. 6) within inner core barrel 26 as the core sample enters and moves into inner core barrel 26. Preferably ball 73 is normally seated to block drilling fluid flow into inner core barrel 26 but will unseat to allow ventilation of the cavity within inner core barrel 26. Ball 73 moves through a cylinder, shown in phantom, between vent 71 and the ball seat for this purpose.

Figure 6:
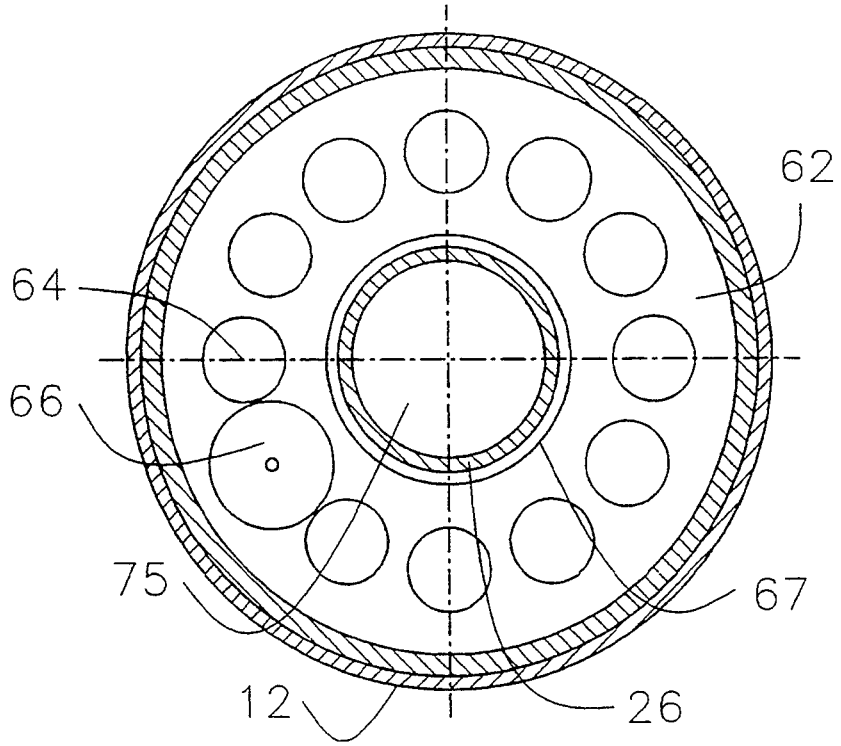
FIG. 6 is a sectional view taken along the lines 6—6 shown in FIG. 5.

FIG. 6 is taken along lines 6—6 of FIG. 5 and provides a top view of stabilizer 62. The position of bore 64 shown in FIG. 5 is indicated. The magnitude of the hydraulic differential is preferably calibrated by adjusting the size of the drilling fluid flow path through one of the stabilizers or through hanger assembly 58 which also preferably has a plurality of axial bores as illustrated in FIG. 6. The flow path may be adjusted in many ways, although simple plugs such as plug 66 may be used to decrease the effective cross-sectional area of the flow path for adjustment of the pressure differential. Plug 66, as shown, is simply a substantially round washer type of plug perhaps mounted by means of a bolt or screw. Plugs or means to adjust the flow may be located in one or more of the stabilizers or in the hanger assembly 58. Preferably the differential should be great enough to provide about 750 pounds of force on the inner coring barrel in a direction towards core head 14. Due to different diameters of the inner barrels which may be used, the flow path restriction can be adjusted accordingly to provide the correct amount of differential hydraulic force. After leaving stabilizer 62, flow path 54 continues towards core head 14 and may proceed out of ports 65 (See FIG. 7) in core head 14 or may proceed out of ports 68 (See FIG. 9) through a lower portion of outer core barrel 12.

Stabilizer bore 67 has an inner diameter just larger than the outer diameter of inner core barrel 26. Thus, the stabilizer supports inner core barrel 26 in a straight position to allow easy entry of the core sample and to prevent fracturing of the core sample. With a 32 foot inner core barrel, preferably five stabilizers are used to stabilize inner core barrel 26 over its length. The interior cavity 75 of inner core barrel 26 is substantially cylindrical and has a circular cross section. The cross-section is taken in a joint of outer core barrel 12 so that inner and outer components of outer core barrel 12 are shown.

Figure 7:
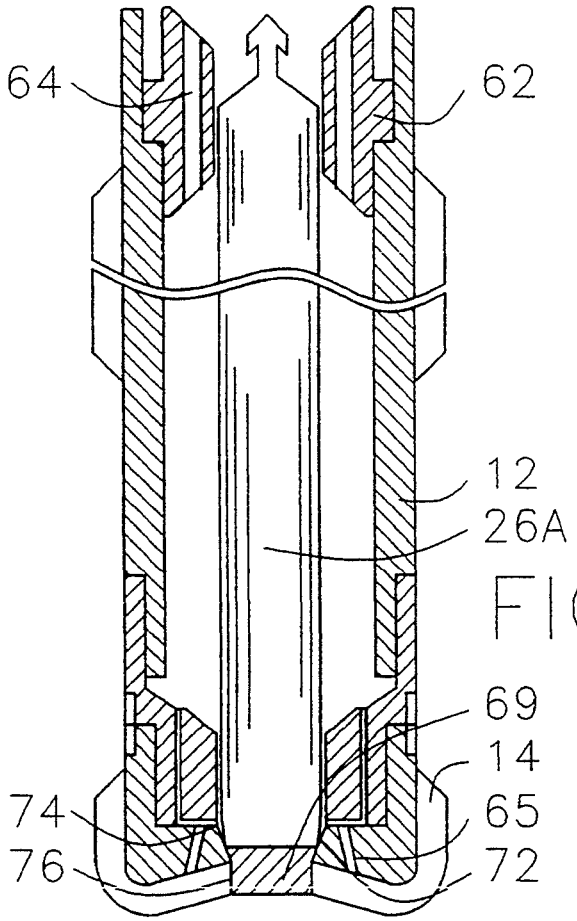
FIG. 7 is an elevational view, partially in section, showing a seal plug for the bore through a coring head in accord with the present invention.

FIG. 7 provides a view of run-in plug 69 that may be used on the end inner core barrel 26 or on a modified inner core barrel **26*a*. The run-in plug 69 permits the service engineer to run the drill string to the bottom of the well without the possibility of a lost core entering the outer barrel. Although run-in plug may be used with the inner core barrel 26 previously described, it is not necessary to have the bearing assembly with run-in plug 69. Axial stop region 72 engages end 74 of inner core barrel 26*a* to secure run-in plug 69 in bore 76 of core head 14 and prevents run-in plug 69 from coming out of bore 76. Because the mud pumps are not normally connected while the drill string is being run to the bottom, the run-in plug is normally held in place by weight rather than hydraulic force. However, if desired, drilling fluid could be pumped through the drill string to hold run-in plug 69** in place.

FIG. 8 shows another modified inner core barrel **26*b* which has drill plug 80 mounted on end 82 of the modified inner core barrel. Drill plug 80 includes drill bit components 83 which complement bit elements 85 of core head 14 to effectively change core head 14 into a drilling bit when coring is no longer desired. Thus, after taking a core sample, it is possible to pull out inner core barrel 26 used for coring and add or replace it with drill plug 80 for drilling ahead. The need to pull out the drill string and replace core head 14 with a conventional bit is thereby eliminated. The bearing assembly is not required on inner core barrel 26*b* for use with drill plug 80 because it is desirable that drill plug 80 rotate with core head 14. Keys, slots, or ball connections such as key 84 may be used to prevent rotation of drill plug 80. As with inner core barrel 26, hydraulic pressure is used to keep drill plug 80 in the desired axial position with respect to core head 14**.

FIG. 9 shows another modified inner core barrel **26*c* which may be used to push tools through bore 76 of core head 14. Tool 87 may be a number of different types of tools. For instance tool 87 could be a logging tool. It may be desirable to log the part of the hole which has just been cored. Core barrel 26*c* may be used to push the logging tool out of bore 76 when, for instance, the bore hole is highly deviated and a logging tool would not normally fall by gravity. It would also be possible to pump a logging tool out of bore 76 after removing the inner barrel. Tool 87 could also be a core punch to obtain a core sample ahead of the bit in soft to medium hardness formations. Thus, core barrel 26*c* would act as a piston to push tool 87** through the formation to obtain a punch core sample.

Thus, to summarize general operation, outer barrel assembly 12 is made up in the drill string similarly to conventional coring systems, except inner barrel 26 is not run. The bottom hole assembly is tripped to bottom. The inner barrel is dropped at the surface and preferably pumped to bottom. Hydraulic pressure seats the bearing assembly into hanger assembly 58. Coring commences after the bearing assembly seats in hanger assembly 58. When coring is completed, an overshot is run on wireline, slickline, or sandline. The overshot latches onto the fishing neck or spearhead at the top of the inner barrel, the inner barrel is pulled, and the core is retrieved. The cycle is continued until the core head is worn or until the complete desired interval is cored.

The foregoing disclosure and description of the invention is illustrative and explanatory thereof, and it will appreciated by those skilled in the art, that various changes in the size, shape and materials as well as in the details of the illustrated construction or combinations of features of the various coring elements may be made without departing from the spirit of the invention.

What is claimed is:

1. A coring assembly for use with a core head, said core head being rotatable by a drill string disposed within a wellbore, said core head having a core head bore therethrough for receiving a core sample, said drill string having a bore therethrough for pumping drilling fluid, said coring assembly comprising:

an outer core barrel, said outer core barrel having an outer barrel bore therethrough, said outer core barrel being connected with said core head for rotation with said core head;

an inner barrel, said inner barrel being axially movable within said outer barrel bore along the axis of said outer barrel bore, said inner barrel having a first end and a second end, said second end being disposed closer to said core head than said first end;

a support member affixed along said outer barrel bore, said support member having annular valve seat means centrally disposed therein, said valve seat means having a bore therethrough for receiving said inner barrel, said support member having a drilling fluid pathway disposed therein to allow axial flow of drilling fluid by said valve seat means; and valve face means disposed around said inner barrel, said valve face means and said valve seat means being sealingly engageable to form a drilling fluid flow restriction for producing a pressure differential within said outer core barrel between said first and second ends of said inner core barrel operable for holding said inner barrel assembly within said outer core barrel in an axially fixed position with respect to said outer core barrel, said valve face means and said valve seat means being substantially rotatably fixed with respect to each other after engagement, said drilling fluid being diverted to said drilling fluid pathway after engagement of said valve face means and said valve seat means.

2. The coring assembly of claim 1, further comprising:

a coring portion of said inner barrel;

a rotatable connection between said valve face means and a coring portion of said inner barrel so that said coring portion of said inner barrel is rotatably mounted with respect to said outer barrel by means of said rotatable connection.

3. The coring assembly of claim 2, wherein said rotatable connection further comprises:

a bearing race having an outer surface, said bearing race being rotatably mounted with respect to said coring portion of said inner barrel, said outer surface of said bearing race having a portion thereof forming said valve face means around said inner barrel.

4. The coring assembly of claim 2, wherein said support member forms an axial stop to prevent further axial movement of said inner barrel along said outer barrel bore toward said core head.

5. The coring assembly of claim 1, wherein said valve face means and said valve seat means each have a circular cross-section.

6. The coring assembly of claim 5, wherein said valve face means and said valve seat means each have a substantially frustoconical portion.

7. The coring assembly of claim 1, wherein said drilling fluid pathway is calibrated to control the magnitude of said pressure differential for holding said inner barrel axially fixed within said outer barrel.

8. The coring assembly of claim 1, wherein said drilling fluid pathway includes a plurality of substantially axially extending passageways disposed radially outwardly with respect to said valve seat means.

9. The coring assembly of claim 1, further comprising:

a plurality of axially spaced stabilizers disposed between said outer barrel and said inner barrel, said plurality of axially spaced stabilizers each having a stabilizer bore therethrough slightly larger than an outer diameter of a respective portion of said inner barrel for preventing radial movement of said inner barrel, said plurality of axially spaced stabilizer each having a flow passageway radially outwardly disposed to said stabilizer bore for drilling fluid flow.

10. The coring assembly of claim 1, further comprising:

plug means disposed on said second end of said inner barrel for sealing said core head bore.

11. The coring assembly of claim 1, further comprising:

drill bit means disposed on said second end of said barrel for insertion in said core head bore, and key means for rotatably securing said drill bit means for rotation with said outer barrel and said core head.

12. The coring assembly of claim 1, further comprising:

a one-way valve disposed adjacent said coring portion of said inner barrel, said one-way valve being in communication with a cylindrical cavity in said coring portion for receiving a core sample, said one-way valve relieving pressure as said core sample is received within said substantially cylindrical cavity.

13. A coring assembly for use with a core head, said core head being rotatable by a drill string disposed within a wellbore, said core head having a core head bore therethrough for receiving a core sample, said drill string having a bore therethrough for pumping drilling fluid, said coring assembly comprising:

an outer core barrel, said outer core barrel having an outer barrel bore therethrough, said outer core barrel being connected with said core head for rotation with said core head;

an inner barrel, said inner barrel being axially movable within said outer barrel bore along the axis of said outer barrel bore, said inner barrel having a first end and a second end, said second end being disposed closer to said core head than said first end;

axial stop means disposed within said outer barrel for preventing axial movement of said inner barrel in the direction of said core head;

a coring portion of said inner barrel;

a rotatable connection between said axial stop means and said coring portion of said inner barrel so that said coring portion of said inner barrel is rotatably mounted with respect to said outer barrel by means of said rotatable connection; and securing means for securing said inner barrel within said outer barrel against said axial stop, said securing means being operable without radially outwardly or radially inwardly movable securing elements.

14. The coring assembly of claim 13, further comprising:

interchangeable drill bit means for replacing said coring portion of said inner barrel, said interchangeable drill bit means being disposed on said second end of said inner barrel for insertion in said core head bore for drilling co-operation with said core head.

15. The coring assembly of claim 14, wherein said interchangeable drill bit means also replaces said rotatable connection.

16. The coring assembly of claim 13, further comprising:

interchangeable plug means for replacing said coring portion plug means, said interchangeable coring portion means being disposed on said second end of said inner barrel for receiving a coring sample.

17. The coring assembly of claim 13, wherein said rotatable connection further comprises:

mud-lubricated bearings.

18. The coring assembly of claim 17, further comprising:

an adjusting nut for said mud lubricated bearings;

threads having a key for securing said adjusting nut in a position axially spaced from said mud-lubricated bearings to allow drilling fluid flow through said mud-lubricated bearings.

19. A method for obtaining a core sample from a borehole cut using a drill string for turning a core head, said core head having a core head bore therethrough for receiving said core sample, said method comprising the following steps:

connecting a core head with an outer coring barrel;

lowering said core head and said outer coring barrel into said well bore using a drill string;

dropping an inner core barrel into said drill string;

connecting a drilling fluid pump to said drill string;

forming a flow restriction between a first end and a second end of said inner core barrel within said outer coring barrel; and pumping drilling fluid through said drill string to axially secure said inner core barrel within said outer coring barrel using a differential fluid pressure between a first end and a second end of said inner core barrel which arises from said drilling fluid flow through said flow restriction, said differential pressure rotatably securing a portion of said inner core barrel to said outer core barrel so that said portion of said inner barrel rotates with said outer core barrel.

20. The method of claim 19, further comprising:

forming a core head bore plug on said second end of said inner core barrel; and sealing said core head bore with said core head bore plug.

21. The method of claim 19, further comprising:

forming a barrel drill bit on said second end of said inner core barrel; and drilling with said core head and said barrel drill bit.

22. The method of claim 19, further comprising:

directing said drilling fluid pumped through said drill string out of a port axially removed from said core head and axially disposed between said core head and said flow restriction to avoid formation breakdown in unconsolidated formations caused by directing said drilling fluid through ports in said core head.

* * * * *